United States Patent [19]

Stetler

[11] 3,985,287

[45] Oct. 12, 1976

[54] CARTON

[76] Inventor: Dwight L. Stetler, 10410 Dorothy Ave., South Gate, Calif. 90280

[22] Filed: Aug. 21, 1975

[21] Appl. No.: 606,485

[52] U.S. Cl. ..... 229/37 R; 229/DIG. 9; 229/17 R

[51] Int. Cl.[2] ..... B65D 5/02

[58] Field of Search ..... 229/37 R, 17 R, DIG. 9

[56] References Cited

UNITED STATES PATENTS

| | | | |
|---|---|---|---|
| 1,223,232 | 4/1917 | Ash | 229/37 R |
| 2,865,550 | 12/1958 | Bergstein | 229/17 R |
| 2,925,948 | 2/1960 | Alden | 229/17 R |
| 3,007,376 | 11/1961 | Hickin et al. | 229/37 R X |
| 3,110,433 | 11/1963 | Mosse et al. | 229/17 R X |
| 3,586,233 | 6/1971 | McCulloch | 229/37 R |

*Primary Examiner*—Davis T. Moorhead
*Attorney, Agent, or Firm*—Fulwider, Patton, Rieber, Lee & Utecht

[57] ABSTRACT

A one-piece blank formable into a carton of rectangular cross section. The blank includes crease lines which define adjacent side panels, two of which are of lesser width and include end panels at their opposite ends. Additional crease lines define sealing flaps for adherence to adjacent portions of the folded carton to provide structural integrity. A plurality of the blanks can be internested for cutting from a single sheet of material with a minimum of waste. For this purpose the width of each of the greater width side panels is made equal to the sum of the width of one of the lesser width side panels, plus twice the combined width of the pair of sealing flaps at the sides of one of the end panels.

5 Claims, 6 Drawing Figures

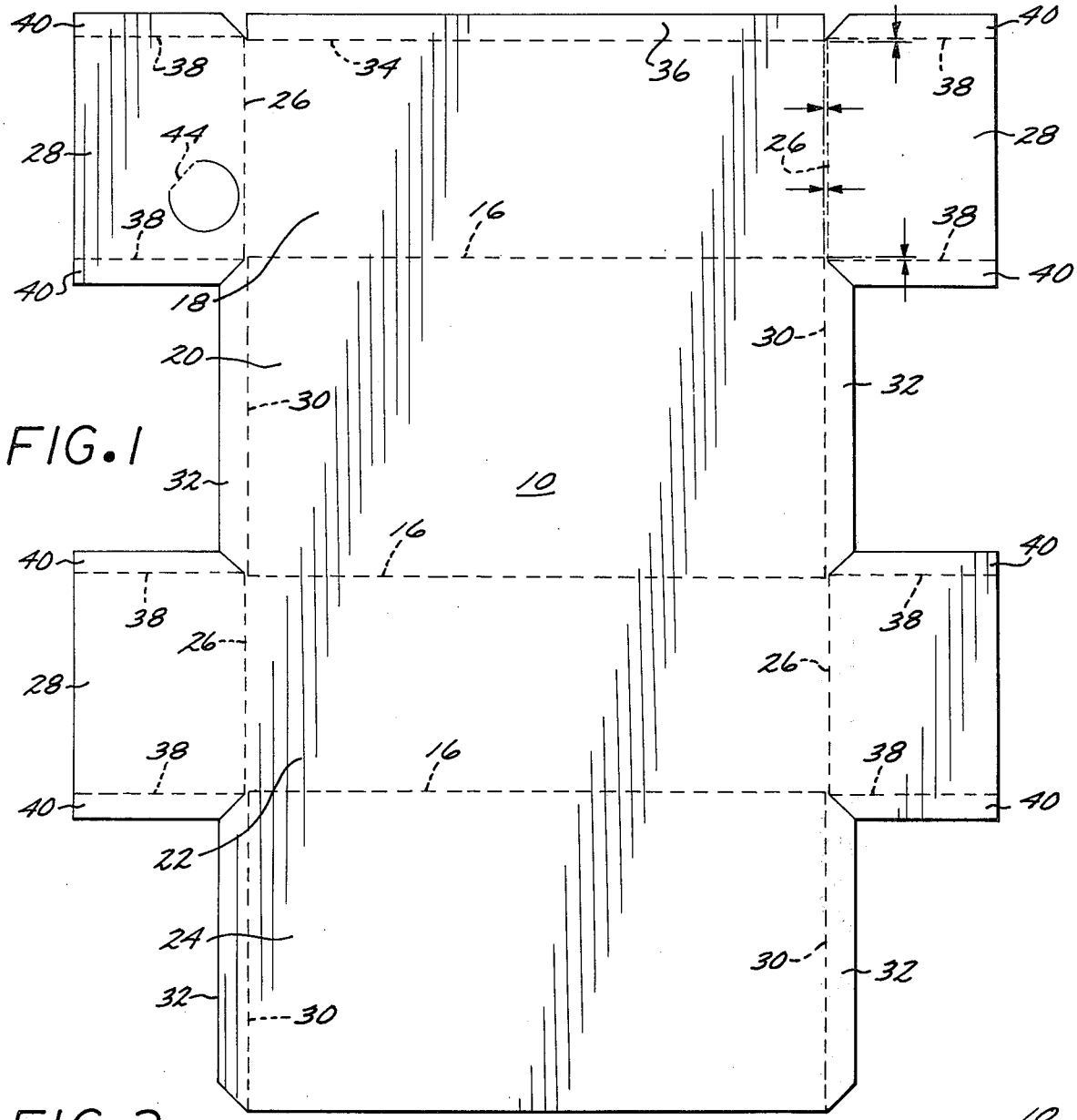
FIG. 1
FIG. 2
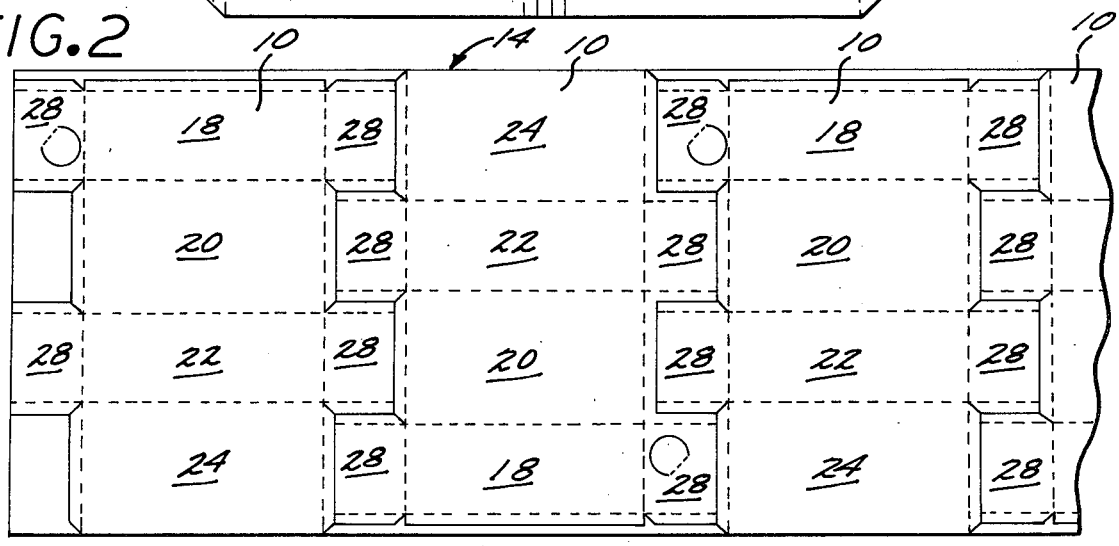

CARTON

BACKGROUND OF THE INVENTION

1. Field of the Invention

The present invention relates to a one-piece blank foldable to form a carton, and particularly a blank adapted to be internested with identical blanks for cutting from a single sheet of material with a minimum of waste.

2. Description of the Prior Art

Although the carton of the present invention is adapted to contain various types of materials, it is particularly adapted for containing liquids. Prior art cartons for this purpose generally fall within three broad types. One carton type is that which is fabricated out of separate component parts. This permits the blanks for the component parts to be closely internested for cutting from a sheet or strip of card stock with very little waste, but individual handling and stocking of the separate parts is a problem and the carton as a practical matter must therefore be assembled at the paper plant rather than at the filling facility. The cost of shipping assembled but empty cartons to the filling facility is prohibitive.

Another type of carton avoids the problem of utilizing separate component parts. It is made of one-piece blank which is scored or creased for folding of the blank into the desired carton. Most of the cartons of this type are wasteful of sheet material, either by virtue of the manner in which they must be folded to form a carton, or by virtue of the inability to closely internest the blanks for cutting from a single sheet or strip of card stock. For example, one such carton blank is creased for folding into an open-ended tube having four side panels and a closure flap at each end of each side wall panel. After the blank side margins are secured together to form the carton tube, the four closure flaps are overlapped at one end in an arrangement which results in several thicknesses of sheet stock where the flaps overlap. This is not only wasteful of material but it complicates the process of quickly and efficiently forming a seal between the overlapping portions. Often such a carton is also characterized by one end in which the end flaps are folded into a triangular, peaked roof configuration. This is also characterized by several thicknesses of overlapping material in certain areas, but it suffers the additional disadvantage of making it impossible to stack such cartons.

A third type of prior art carton is characterized by a one-piece blank foldable to form the carton, but the geometry or configuration of the carton blanks and the sizes of the panels and end flaps are such that a plurality of such blanks cannot be cut out of a single sheet of material without significant waste.

SUMMARY OF THE INVENTION

According to the present invention a one-piece blank is provided which is foldable to form a flat-ended carton of rectangular cross section. The configuration of the blank is such that a plurality of such blanks can be internested for cutting from a single sheet of material with a minimum of waste. For this purpose, the carton is made rectangular, and the two side panels of lesser width each include what may be termed "half" flaps or end panels at their ends. Thus, instead of the wasteful arrangement of the prior art, in which the end of the carton is formed by a single flap extending all the way across the carton end, or by a pair of overlapping flaps extending across the carton end, each half flap extends slightly more than half way across the end of the carton, overlapping just enough to enable formation of a good seal. As will be seen, by utilizing such half flaps, and employing two side panels of lesser width to thereby form a rectangular carton, the carton blanks can be very closely internested for cutting from a single sheet or strip of card stock with negligible waste. The savings in material is very significant, amounting to almost ten per cent over comparable types of prior art cartons. This is an extremely important savings, having in mind the present need for conservation of energy and materials, and the millions of cartons used in this country for milk and the like. The one-piece blank of the present invention comprises a sheet material body portion having score or crease lines which define four side-by-side panels, and "half" flap or end panels at the ends of the first and third side panels. The crease lines further define sealing flaps at the ends of the second and fourth side panels, at the sides of the end panels, and also at the free side of the first side panel. The width of each of the second and fourth panels is made equal to the width of one of the first and third side panels plus twice the combined width of a pair of the sealing flaps at the sides of each end panel. With this configuration and proportionate width, a plurality of such carton blanks can be internested for cutting from a single sheet of material with almost no waste.

The configuration and flat ends of the present carton offer other advantages. For example, the two wider side panels provide an ideal wide space for the prominent display of advertising material. Also, the flat carton ends permit the cartons to be easily stacked for storage and display, and the rectangular shape of the carton makes it easier for a person to grasp, which is important in handling a milk carton of one quart or larger sizes.

The score or crease lines are preferably off-set in certain areas to compensate for the thickness of the sheet stock so that the blank can be folded and sealed together to form the carton with minimum bending, crumpling and other distortion.

Other objects and features of the invention will become apparent from consideration of the following description taken in conjunction with the accompanying drawings.

BRIEF DESCRIPTION OF THE DRAWINGS

FIG. 1 is a plan view of a one-piece carton blank according to the present invention;

FIG. 2 is a plan view of a plurality of blanks illustrated in FIG. 1, the blanks being internested on a single sheet of card stock material prior to cutting or punching of the material to form the individual blanks;

DESCRIPTION OF THE PREFERRED EMBODIMENT

Figure 3:
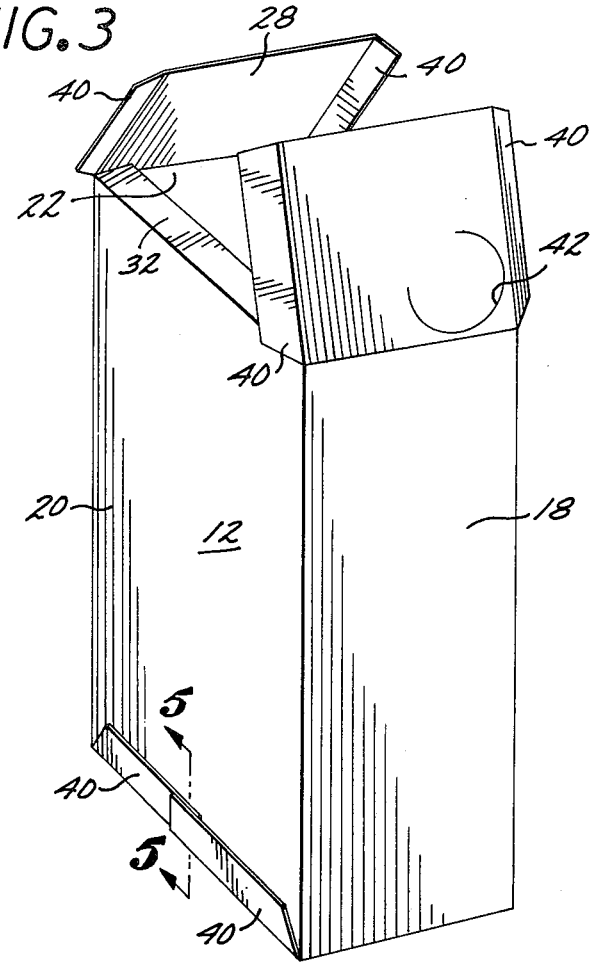
FIG. 3 is a perspective view of a rectangular carton formed from the blank of FIG. 1, the upper end panels being illustrated prior to closure.
Figure 4:
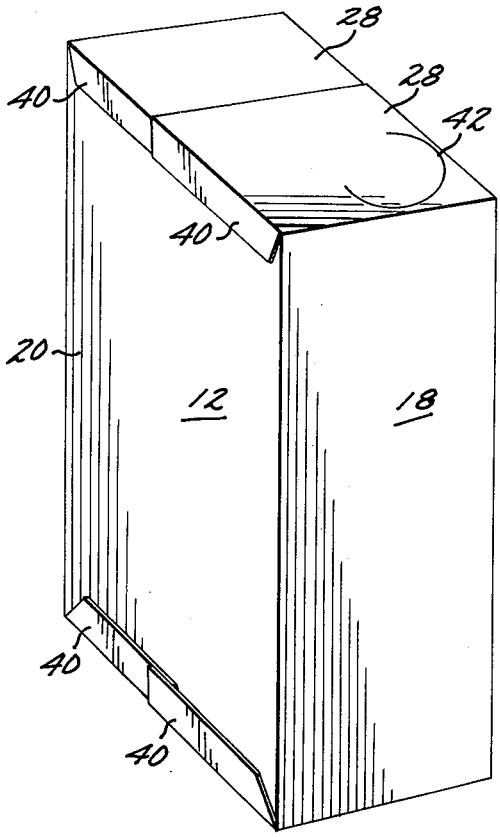
FIG. 4 is a view similar to FIG. 3, but illustrating the upper end panels in their closed state.
Figure 5:
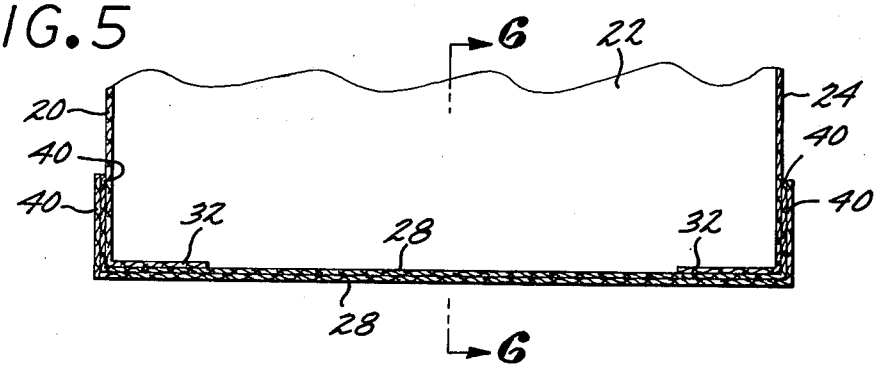
FIG. 5 is an enlarged partial view taken along the line 5—5 of FIG. 3.
Figure 6:
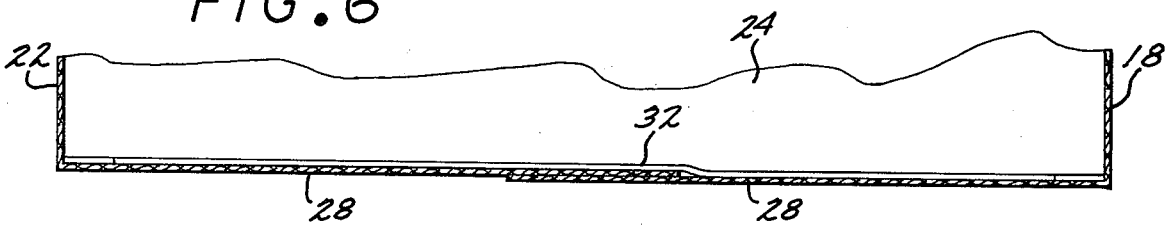
FIG. 6 is an enlarged detail view taken along the line 6—6 of FIG. 5.

Referring now to the drawings, there is illustrated a one-piece blank 10 which is foldable to form a carton 12 of rectangular cross section, as best seen in FIG. 4. A plurality of the blanks 10 are closely internested in a single sheet or strip of card stock or sheet material 14, as best illustrated in FIG. 2. In the embodiment herein described, the carton 12 is particularly adapted for use as a half-gallon milk carton, in which case the sheet material 14 is 24 point paperboard coated with polyethylene on both sides. Sealing of the adjacent portions of the blank 10 during folding of the blank into the shape of the carton 12 is effected in a well known manner by pressing together such portions and applying heat by suitable means to melt the polyethylene. Allowing the polyethylene to cool effects a liquid tight seal between the joined portions.

As will be seen, the blank 10 is provided with score or crease lines to facilitate folding of the blank 10 into the carton shape. Such crease lines and cutting of the blanks 10 from the sheet material 14 can be done by hand if desired, but it is preferred that such creasing and cutting be performed in a continuous manner by suitable machines.

Although the description of the carton 12 is made with reference to a paperboard half-gallon milk carton, the carton of the present invention is adapted to hold other materials, both liquid and non-liquid, it can be made of other materials, it can be provided with adhesive materials other than polyethylene, and it can be differently dimensioned.

As best seen in FIG. 1, each blank 10 comprises a sheet material body portion which includes score, fold, or crease lines 16 defining side-by-side, consecutively arranged rectangular first, second, third and fourth side panels 18, 20, 22, and 24 respectively. The crease lines forming the side panels 18, 20, 22 and 24 are arranged in parallel relation and are made approximately .050 inches in width for the 24 point paperboard utilized in the particular embodiment described.

The side panels 18 and 22 are of equal width, and the panels 20 and 24 are also of equal width. The side panels 18 and 22 are of lesser width than the panels 20 and 24, which therefore defines a rectangular carton on subsequent folding of the blank.

Additional crease lines 26 extending generally normally of the crease lines 16 define rectangular end panels 28 at opposite ends of the side panels 18 and 22. The panels 28 are in effect longitudinal extensions of the side panels 18 and 22.

Further crease lines 30, parallel to the crease lines 26, define sealing flaps 32 at the ends of the panels 20 and 24.

Another crease line 34 defines a sealing flap 36 at the free edge margin or side of the side panel 18. Sealing flaps 40 at the sides of each of the end panels 28 are formed by crease lines 38 extending generally parallel to the crease lines 16. The flaps 40 are substantially equal in width, and approximately equal in width to the width of each of the flaps 32 and 36.

As best seen in the detail showing in the upper right hand corner of FIG. 1, each crease line 26 defining an end panel 18 is outwardly spaced or offset relative to the crease line 30 of the adjacent side panel. Similarly, each crease line 38 defining one of the flaps 40 is outwardly offset relative to the crease line 16 or 34, as the case may be, of the adjacent side panel. The term "outwardly" as used herein is intended to denote toward the free edge of the particular end panel 28.

The offset relation of the crease lines 26 and 38 is indicated by the pairs of opposed arrows shown in FIG. 1, the offset being approximately 0.024 to 0.026 inches for 24 point paperboard. The purpose of the offset is to enable easy folding over or wrapping of the end panels 28 and the sealing flaps 40 onto adjacent carton components without wrinkling or similar distortion of the blank material.

In the half-gallon milk carton 12 herein described as an exemplary embodiment, each side panel 18 and 22 measures approximately 3⅛ inches in width, while the side panels 20 and 24 each measure approximately 4⅝ inches. The longitudinal dimension of the side panels is 8⅜ inches, while that of each end panel 28 is approximately 2 7/16 inches. Each sealing flap 32, 36, and 40 is preferably the same, being approximately ⅜ inches.

The width of the side panels 18 and 22 relative to the side panels 20 and 24 is an important feature of the present invention because it permits exact internesting of the blanks 10 on the sheet material 14, as best illustrated in FIG. 2. Such close internesting permits a very significant savings in material costs, which is critical where high volume runs are concerned. Moreover, the saving of materials is important for energy conservation purposes.

In this regard, the side panels 20 and 24 each have a width equal to the width of one of the side panels 18 and 22 plus the width of four of the sealing flaps 40. Stated another way, and with particular reference to FIG. 2, it is seen that the narrower side panels 18 and 22 with their end panels 28 exactly fit into the spaces between the end panels 28 of an adjacent blank 10. In order to accomplish this, the adjacent blank has to be rotated in the plane of the sheet material through 180 degrees so that the top end panels of one blank internest with the bottom end panels of the other blank. In addition, each of the wider side panels 20 and 24 is made wide enough to receive, in the blank space adjacent to each of their ends, the two side flaps 40 of the adjacent end panels 28, an end panel 28 of the adjacent blank, and the two side flaps 40 of that end panel 28. Since the four side flaps 40 are about equal in width, the relationship of the widths of the side panels 18 and 22 to the side panels 20 and 24 is conveniently stated as above-mentioned. That is, each wide panel is equal to the width of one narrow panel plus four side flaps.

In the example at hand, this means the width of each side panel 20 and 24 is derived by adding the width of a narrow panel 18 or 22, which is 3⅛ inches, to the width of four of the sealing flaps 40, which is 1½ inches, which totals 4⅝ inches.

Except for the opposite ends of the sealing flap 36, and the outer ends of the sealing flaps 40, the ends of the sealing flaps 32, 26, and 40 are cut or formed at approximately a 45° angle to facilitate folding of the flaps during formation of the carton 12.

The contents of the carton 12 are dispensed through a generally circular dispensing flap 42 formed in one of the end panels 28. The flap 42 is partially cut through the material of the blank 10 so that it can be easily popped out and hinged outwardly. A crease line 44 defines a hinge line along which the flap 42 can bend when it is opened and closed.

Forming the carton 12 from the blank 10 is effected by first cutting the blanks 10 out of the sheet material 14. Next, the sealing flaps are folded at approximately a ninety degree angle. The blank is then folded along the crease line 34, and along the longitudinal crease lines 16. This brings the sealing flap 36 in underlying relation to the free outer margin or side of the side panel 24. The flap 36 is sealed in this position in any suitable manner, as by pressing the overlapping parts against a mandrel (not shown) located internally of the carton 12, and applying heat to melt the polyethylene coating on the flap 36. This forms a liquid tight seal on cooling of the polythylene material.

The carton at this stage is tubular in form and rectangular in cross section, with the end panels 28 extending outwardly as continuations of the side panels. Next, the bottom end of this tubular form is closed by folding one of the end panels 28 at one end of the side panel 22 inwardly along the crease line 26. Since the end panel 28 is not a full length cover in the preferred embodiment, it closes off a little more than half of the end opening. The opposite panel 28 is next folded along its crease line 26 until its outer free margin overlaps the outer free margin of the first end panel 28. At this time the flaps 32 underlie the end panels 28, and the flaps 40 are bent or folded downwardly and overlap the adjacent surfaces of the side panels 20 and 24.

Preferably an internal mandrel is used for pressing the adjacent parts together, and heat is applied to melt the polyethylene coating. When the polyethylene coating cools a liquid tight seal is achieved between the overlapped portions just described.

Closure of the top end of the tubular body of the carton 12 is accomplished in a manner identical to the just-described closure of the bottom end except that no internal mandrel is used. Instead, any suitable external means (not shown) is used to support the side panels while simultaneously pressing inwardly upon the overlapped portions of the top end during heating and subsequent cooling of the polyethylene coating.

This completes the folding of the carton blank into the carton 12. The resulting carton is characterized by flat ends so that a plurality of the cartons can be easily stacked upon one another. In addition, the rectangular configuration of the container allows it to be easily stored in a refrigerator or the like, and also makes it easy for a person to grasp. Of great significance is the fact that the blanks 10 can be exactly nested, eliminating nearly all waste and permitting adjacent blanks to be cut from sheet stock with a single cut. The offset score lines of each blank allow for the thickness of the sheet stock when the blank is folded so that the finished carton is characterized by an undistorted, symmetrical shape.

Various modifications and changes may be made with regard to the foregoing detailed description without departing from the spirit of the invention.

I claim:

1. A one-piece blank foldable to form a carton of rectangular cross section having closed ends, said blank comprising:

a sheet material body portion;

said body portion including crease lines defining side-by-side, consecutive first, second, third and fourth side panels, further defining end panels at the ends of said first and third side panels, and further defining sealing flaps at the sides of said end panels; and each of said second and fourth side panels having a width equal to the sum of the width of one of said first and third side panels, and four times the width of one of said sealing flaps at the sides of one of said end panels, whereby a plurality of blanks may be internested in end-to-end relation for cutting from a single sheet of material with a minimum of waste.

2. A one-piece blank according to claim 1 and including crease lines defining sealing flaps at the ends of said second and fourth side panels, and at the free side of said first side panel.

3. A one-piece blank according to claim 1 wherein the length of each said end panel is less than the width of one of said second and fourth panels whereby the free edge margins of adjacent end panels overlap in the formed carton.

4. A one-piece blank according to claim 1 wherein said crease lines defining said sealing flaps for each said end panel are outwardly offset relative to said crease lines defining the adjacent one of said first and third side panels.

5. A one-piece blank according to claim 2 wherein said crease lines defining said end panels are outwardly offset relative to said crease lines defining the adjacent one of said sealing flaps at the ends of said second and fourth side panels.

* * * * *